United States Patent [19]

van der Harst

[11] 4,203,547

[45] May 20, 1980

[54] RAILWAY LEVEL CROSSING

[75] Inventor: Pieter A. van der Harst, IJmuiden, Netherlands

[73] Assignee: Hoogovens IJmuiden, B.V., IJmuiden, Netherlands

[21] Appl. No.: 886,835

[22] Filed: Mar. 15, 1978

[30] Foreign Application Priority Data

Mar. 22, 1977 [NL] Netherlands ..... 7703072

[51] Int. Cl.[2] ..... E01C 9/04

[52] U.S. Cl. ..... 238/8; 238/381

[58] Field of Search ..... 238/2, 3, 4, 5, 6, 7, 238/8, 9, 379, 380, 381; 267/35

[56] References Cited

U.S. PATENT DOCUMENTS

| | | | |
|---|---|---|---|
| 402,022 | 4/1889 | Knapp | 238/381 X |
| 566,096 | 8/1896 | Roberts | 238/381 |
| 1,730,709 | 10/1929 | Wolfgram | 238/8 |
| 2,574,926 | 11/1951 | Manley | 238/8 |
| 2,828,080 | 3/1958 | Rennels | 238/8 |
| 3,465,963 | 9/1969 | Caillet et al. | 238/8 |
| 3,469,783 | 9/1969 | Uralli et al. | 238/8 |

FOREIGN PATENT DOCUMENTS

| | | | |
|---|---|---|---|
| 209948 | 8/1940 | Switzerland | 238/8 |

*Primary Examiner*—Randolph A. Reese

*Attorney, Agent, or Firm*—Stevens, Davis, Miller & Mosher

[57] ABSTRACT

A railway level crossing (grade crossing) is described in which the road surface between the rails is, at least adjacent the rails, provided by flexible plates, e.g. rubber plates. The plates extend right to the rails and under their edge portions adjacent the rails are resilient support means which allow the plate to flex downwardly when engaged by the flange of a wheel passing on the rail. The resilient support may be a gas-filled tube extending parallel to the rail.

4 Claims, 3 Drawing Figures

RAILWAY LEVEL CROSSING

BACKGROUND OF THE INVENTION

1. FIELD OF THE INVENTION

The invention relates to a railway level crossing, i.e. a crossing where road and rail are at the same level. This is also known as a grade crossing.

2. DESCRIPTION OF THE PRIOR ART

According to a press report, a new method has been adopted, initially in Recklinghausen, by the German Federal Railway in concert with Chemische Werke Hüls AG and Gummiwerk Kraiburg, for the completion of much frequented railway level crossings, by replacing the hitherto usual road surface of asphalt, concrete plates or pavement by pre-shaped plates of a thickness of 193 mm and made of synthetic ethylene-propylene rubber. This material ("Allwetterkautschuk Buna AP") is highly resistant to ozone, ultraviolet light and other atmospheric effects. At raised temperatures it also displays good resistance to ageing, that is to say has no tendency to become brittle or to formation of cracks. The danger of road vehicles skidding in wet weather is prevented by the special profiling of the surface. The plates are provided with accurately profiled recesses for the sides of the rails and for fastening them to the rails, so that a fixed connection is assured. In addition to the technical advantages of considerably reducing assembly time and better resistance to road traffic, this new development is distinguished by a substantial reduction in the noise level of the road traffic crossing the rails.

Another known level crossing design, described in the leaflet "Rubber level crossings" of Trelleborgs Gummifabriks AB, is also based on a special rubber plate lying on a bed of joined-together wooden longitudinal beams, and completely covering this bed. The edges of the plates lying between the rails are provided with deep pre-shaped channels for the wheel flanges of a train. The lip of the channel directed upwards under the rail head is pressed against the underside of the rail head, so that the rubber plate is kept in its place on the wooden bed without the use of nails, bolts or adhesives. At the same time this results in effective sealing against dirt which might penetrate into the ballast bed. One of the advantages mentioned for such a level crossing is easier cleaning. On level crossings in industrial areas the channel need only be cleaned once in a while. Because of the elasticity of the rubber, removal of ice is also no longer a problem. Clamps screwed onto the ends of the bed of beams prevent the plates from shifting in the longitudinal direction.

U.S.A. Pat. No. 3,465,963 shows a level crossing in which the gap between a reinforced rubber plate and the rail is filled by an elastomeric strip. This strip has cavities in its underside enabling it to be resiliently deformed by the flange of a passing wheel.

U.S.A. Pat. No. 3,469,783 shows a level crossing wherein gaps between a concrete bed and the rails are filled by a cushioning member having internal cavities to allow it to be resiliently deformed by a passing flange.

SUMMARY OF THE INVENTION

An object of this invention is to provide an improved railway level crossing of the type having rubber plates forming at least part of the road surface between the rails.

Another object is to provide a railway level crossing in which it is not possible for a shoe heel or bicycle tire to get caught in a groove beside the rail.

Yet another object is to provide a railway level crossing which is not affected by dirt and refuse collecting in a groove and is resistant to adverse weather conditions.

The present invention is based on the realization that a pre-shaped channel to accomodate the wheel flanges of a train in the rubber plate is neither necessary or desirable in view of the risk, with the known design, of a shoe heel or a bicycle tire getting caught in said channel.

Therefore, the construction according to the invention is characterized in that an unyielding bed is provided between the rails and, at least adjacent each of the rails, the said road surface between the rails is provided by at least one flexible plate. The flexible plate is supported by said unyielding bed and has an edge portion extending to closely adjacent the rail. Thus even if there is any gap between the rail and the flexible plate, the gap has a width less than the amount by which a wheel flange projects laterally of the rail when a wheel passes along the rail.

Said edge portion of the flexible sheet is not directly supported by said unyielding bed whereby said edge portion can bend downwardly when engaged by a flange of a flanged wheel passing along the rail. There is further provided resilient means supporting said edge portion of the flexible plate and adapted resiliently to restore said edge portion to its normal position when the flanged wheel has passed. This closed construction adjacent the rail means that street refuse is blown across the level crossing and cannot accumulate in a groove.

Preferably said resilient means comprises, at least one gas-filled sealed tube of flexible material extending beneath the said edge portion of the flexible plate parallel to the rail and supported by a base. Such a tube may be a single unit extending across the full width of the road, but it can also be sub-divided into separate sections forming a plurality of tubes arranged end-to-end.

This resilient means may, in an alternative arrangement, consist of plate springs incorporated in the edge portion of the plate.

Preferably in order to promote easy bending of the plate, the flexible plate rests upon a portion of said unyielding bed at a region spaced from the rail the said portion of the unyielding bed having at its side towards the rail a top surface which is downwardly rounded to accommodate said flexing of the flexible plate.

BRIEF DESCRIPTION OF THE DRAWINGS

An embodiment of the invention will now be described by way of non-limitative example with reference to the accompanying drawings, in which.

DESCRIPTION OF THE PREFERRED EMBODIMENT

Figure 1:
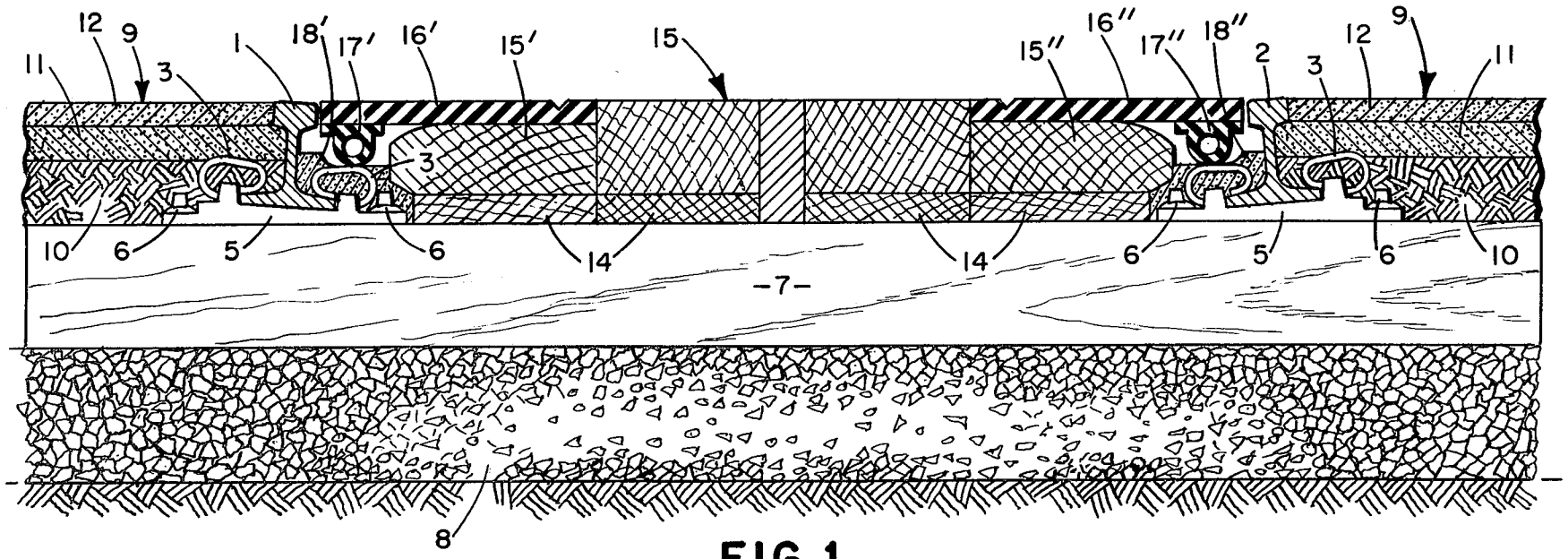
FIG. 1 shows in cross-section a single-track level crossing construction embodying the invention.

FIG. 1 shows a single-track level crossing, in which rails 1 and 2 are fastened to crossing ties 7 in the usual way by fastening means 3 (hammer head bolts, vice clamps), backing plates 5 and collar bolts 6. However, the invention is applicable to other constructions of the track. Under the railway track the usual ballast bed 8 is provided.

The road 9, which crosses the railway on the same level, is in the illustrated example provided with a road foundation 10, upon which an asphalt binder 11 as well as a surface layer 12 have been provided. At the outsides of the rails 1 and 2, the gaps next to the ties 7 and the rail feet are filled with ballast gravel 13.

Wooden packing pieces 14 are provided between the rails 1 and 2 on the ties 7, upon which a bed 15 made up of joined-together wooden longitudinal beams rests to form an unyielding bed or flooring. Upon the lateral edge beams 15', 15" of this bed 15, rubber plates 16', 16" lie with their outside edges between and against rails 1 and 2. The use of two strips 16' and 16" particularly if the level crossing is situated on a curve of the railway track—can offer the advantages on the one hand of accurate measurements and on the other hand that these strips can be more easily pressed against the rails. (To give an example, a strip can measure 40 cm in width and 25 mm in thickness; the crevice between the edge of the strip and the side of the rail is about 1 mm wide and the distance between the top of the tie 7 and the top surface of the rubber plates amounts in this example to 19 cm). Between the strips 16' and 16" the bed 15 of the longitudinal beams thus at the same time forms part of the road surface between the rails 1 and 2. At their inside edges, the strips 16' and 16" are fastened to the underlying beams 15' and 15" respectively, preferably by means of a metal corner fillet (not shown) and wood screws countersunk into it.

The edge beams 15' and 15" at their sides towards the rails 1 and 2 respectively have their top surfaces rounded downwardly to accommodate the flexing of the plate described below.

Figure 2:
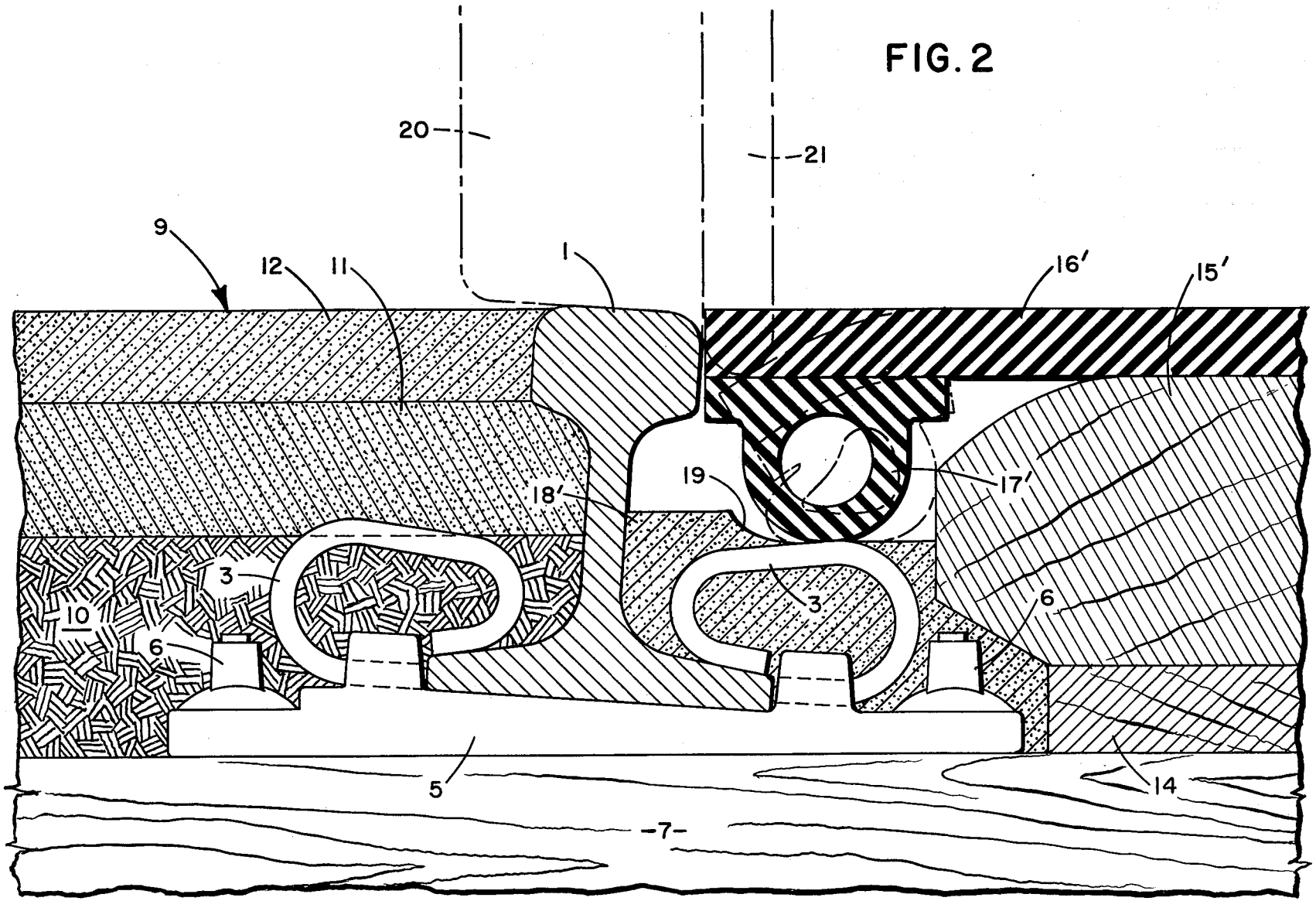
FIG. 2 shows a detail from FIG. 1 on an enlarged scale.
Figure 3:
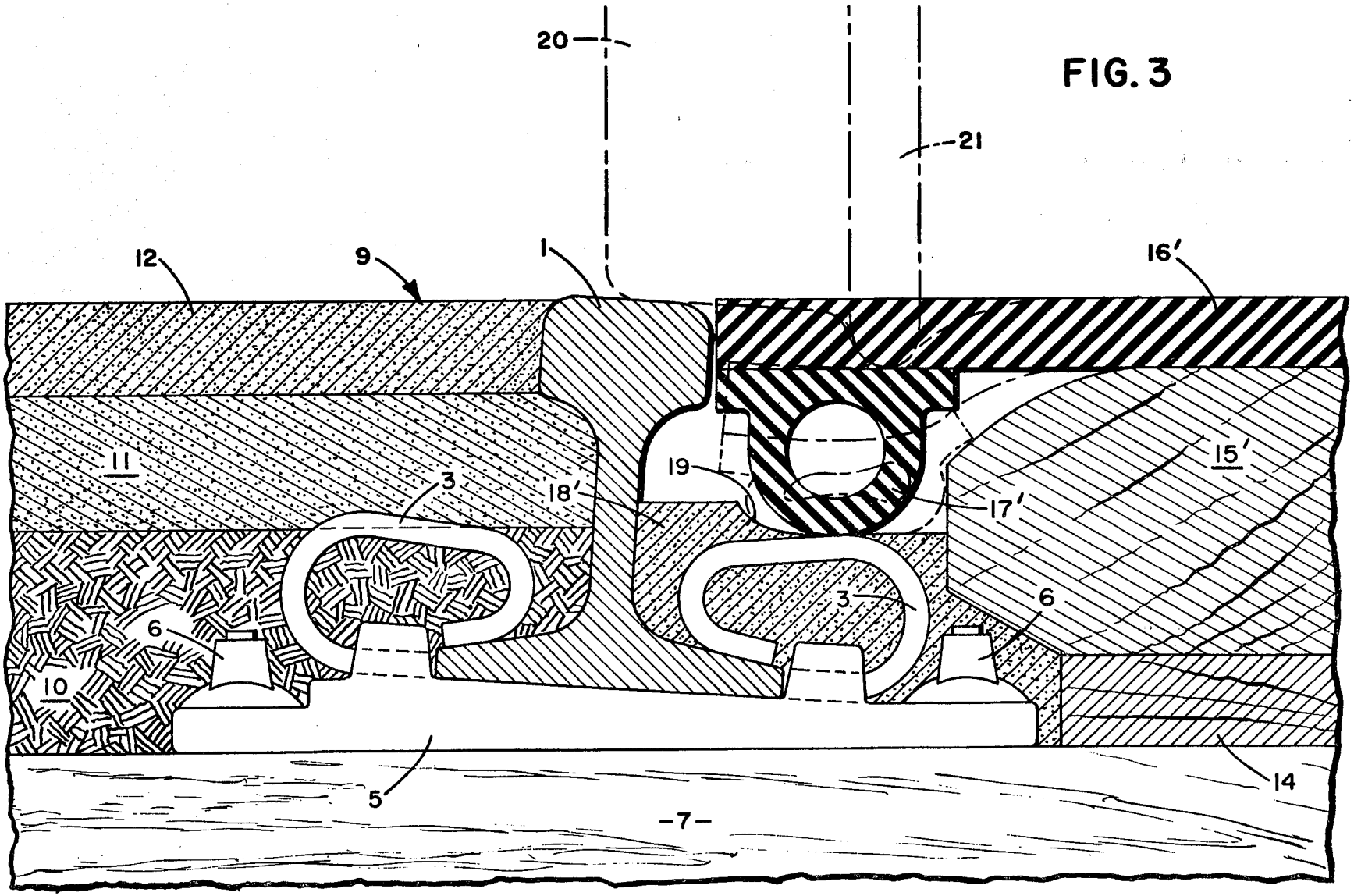
FIG. 3 shows the same detail as FIG. 2 for another position of the wheel on the rail.

Beneath the tongue or edge portion of each plate 16' and 16" overhanging the gaps between the beams 15', 15" and the rails 1,2 there is provided a closed rubber hose 17' and 17" filled with gas under pressure. These hoses 17', 17" rest on bases 18', 18" of for instance cold asphalt and give resilient support to the respective edge portions of the plates 16',16". As is apparent from the Figures, each hose 17', 17" has a circular cross section in its unloaded state. The hoses 17', 17" are attached to the bottoms of the respective plates 16',16", preferably with adhesive and have for example a diameter of 95 mm and a wall thickness of 8 mm. FIGS. 2 and 3 also show that the hose 17' rests in a recess 19 of the base 18', in order to prevent it from sliding away towards the rail. The hose may either extend across the full width of the level crossing or be sub-divided into separate sections. Subdivision may in particular be employed if the railway has a curve in that particular place.

FIGS. 2 and 3 show by broken line the degree of bending of the rubber plate 16' by the flange 21 of a wheel 20 of a passing railway vehicle. In FIG. 2 the flange 21 runs practically against the rail head, and in FIG. 3 is further from the rail head. In either case the deformation of the plate 16' and the hose 17' (drawn as a broken line) is only local and the pressure in the hose 17' ensures that the plate 16' resumes its flat position immediately after the wheel 20 has passed. Since the diameter of the hose 17' is large in proportion to the distance by which the wheel flange projects downwards from the rail head, there is no risk of the hose being pinched off by the passing flange.

The railway level crossing according to the invention therefore lacks the usual groove which enables the wheel flange to pass. Because of the smooth sealing of the groove according to the invention, the danger of shoe heels, tires of bicycles or mopeds or street refuse (sand, leaves etc) entering the groove—which danger will particularly be in evidence if the road and the railway cross each other at an oblique angle (for example of 45°)—can be completely eliminated. Thus a bicycle or moped wheel does not press down the rubber support plate to any appreciable extent, while is stands to reason that the wheel flanges of a train indeed do so.

Instead of a rubber hose the resilient support means for the plates may consist of plate springs (not shown) incorporated in the tongues or edge portions of the plates.

Advantages obtainable with the present invention are:

1. that the rail construction may continue unchanged in the crossing and on either side thereof;
2. the road surface is flat right up to the rail head, so hindering dirt from entering a groove (dirt and dust might in the long run cause damage to the crossing);
3. the rubber plates may be detachable on one side, so that dirt can be removed from time to time;
4. the rubber hose can be installed with the right internal pressure for good support for road traffic;
5. it is hardy to winter weather conditions (frost, snow, hail);
6. any unsymmetry of the position of the wheel flanges with respect to the rails does not affect its functioning.

What is claimed is:

1. A railway level crossing comprising two spaced apart rails constituting the rail track at the crossing and a road surface between the rails substantially at the level of the top surfaces of the rails, wherein an unyielding bed is provided between the rails and, at least adjacent each of the rails, the said road surface between the rails being provided with at least one flexible plate which is supported by said unyielding bed and has an edge portion extending to closely adjacent the rail, said edge portion not being directly supported by said unyielding bed whereby said edge portion can bend downwardly when engaged by a flange of a flanged wheel passing along the rail, there further being provided resilient means supporting said edge portion of the flexible plate and adapted resiliently to restore said edge portion to its normal position when the flanged wheel has passed, said resilient means comprising at least one gas-filled sealed tube of flexible material extending beneath the said edge portion of the flexible plate parallel to the rail and supported by a base.

2. A railway level crossing according to claim 1 wherein a single said tube extends parallel to the rail across the full width of the road.

3. A railway level crossing according to claim 1 wherein a plurality of said gas-filled sealed tubes are arranged end-to-end across the full width of the road.

4. A railway level crossing comprising two spaced apart rails constituting the rail track and having top surfaces;

a road surface between the rails substantially at the level of said top surfaces;

at least one flexible plate of elastomeric material providing a portion of said road surface adjacent each rail, at each rail said plate having an edge closely adjacent said top surface of the rail whereby the top surface of the rail and the road surface between the rails are substantially continuous;

a bed of elongate rigid beams lying between the rails and supporting said flexible plates, there being a gap between a lateral edge of said bed of beams and each rail whereby the said plate can flex downwardly to allow passage of a flange of a wheel on the rail; said beams being downwardly rounded towards the rail adjacent each of said gaps;

at least one gas-filled closed tube located in each of said gaps extending parallel to the rail and providing resilient support of said plate whereby the plate is returned to its normal position after passage of a flange; and rigid support means beneath said tube.

* * * * *